US009180328B2

(12) United States Patent
Schaffer et al.

(10) Patent No.: US 9,180,328 B2
(45) Date of Patent: Nov. 10, 2015

(54) TRAMPOLINE

(71) Applicant: Plum Products Holdings Pty Ltd, Neutral Bay, New South Wales (AU)

(72) Inventors: Jonathan Michael Schaffer, Woking (GB); Christopher J. Neale, Cannock (GB)

(73) Assignee: PLUM PRODUCTS HOLDINGS PTY LTD, New South Wales (AU)

( * ) Notice: Subject to any disclaimer, the term of this patent is extended or adjusted under 35 U.S.C. 154(b) by 0 days.

(21) Appl. No.: 14/330,093

(22) Filed: Jul. 14, 2014

(65) Prior Publication Data

US 2014/0323272 A1 Oct. 30, 2014

Related U.S. Application Data

(62) Division of application No. 12/812,562, filed as application No. PCT/GB2009/000066 on Jan. 9, 2009, now Pat. No. 8,790,221.

(30) Foreign Application Priority Data

Jan. 12, 2008 (GB) ..... 0800506.8

(51) Int. Cl.
*A63B 5/11* (2006.01)
*A63B 71/02* (2006.01)

(52) U.S. Cl.
CPC *A63B 5/11* (2013.01); *A63B 71/022* (2013.01)

(58) Field of Classification Search
CPC ... A63B 5/11; A63B 2067/005; A63B 71/022
USPC ..... 482/23, 26, 27, 28, 29, 35, 77, 78
See application file for complete search history.

(56) References Cited

U.S. PATENT DOCUMENTS 3,201,126 A 8/1965 Nissen
3,501,141 A 3/1970 Nissen et al.
5,941,798 A 8/1999 Coan et al.

(Continued)

FOREIGN PATENT DOCUMENTS

WO WO-2005/058428 A1 6/2005

OTHER PUBLICATIONS

Acacia Law Re-Examination Request on Australian Patent No. 2009203614, to the IP ; Australia, dated Oct. 2, 2013; pp. 1-38.

(Continued)

*Primary Examiner* — Loan H Thanh
*Assistant Examiner* — Sundhara Ganesan
(74) *Attorney, Agent, or Firm* — Rabin & Berdo, P.C.

(57) ABSTRACT

A trampoline comprises a trampoline sheet or mat supported around its periphery from a circumextending support structure by spring couplings, preferably a plurality of helical springs, under tension. The trampoline is provided with a net enclosure in which a generally circumextending net is mounted by respective sheaths on a plurality of poles coupled to the support structure and extending generally upright therefrom. In use, for the greater part of its height, the position of the net corresponds generally to the periphery of the support structure, while lower edge regions of the net are coupled to the periphery of the sheet or mat inboard of the support structure, thereby at least largely preventing a user from falling or treading upon the spring couplings or on an annular pad overlying said couplings, if present.

16 Claims, 3 Drawing Sheets

(56) References Cited

U.S. PATENT DOCUMENTS

| | | | |
|---|---|---|---|
| 6,053,845 | A | 4/2000 | Publicover et al. |
| 6,071,213 | A | 6/2000 | Raasch et al. |
| 6,135,922 | A | 10/2000 | Nissen |
| 6,261,207 | B1 | 7/2001 | Publicover et al. |
| 6,607,468 | B1 | 8/2003 | Nichols, Jr. et al. |
| 7,641,594 | B2 | 1/2010 | Hickey |
| 7,762,927 | B1 | 7/2010 | Gordon |
| 2004/0121883 | A1 | 6/2004 | Publicover |
| 2006/0058157 | A1 | 3/2006 | Greiner et al. |
| 2006/0194674 | A1 | 8/2006 | Hickey |
| 2006/0270525 | A1 | 11/2006 | Colling |
| 2007/0004559 | A1 | 1/2007 | Alexander |
| 2007/0004560 | A1 | 1/2007 | Nelson |
| 2008/0269019 | A1 | 10/2008 | Lovley, II |
| 2008/0269020 | A1 | 10/2008 | Alexander |
| 2008/0269021 | A1 | 10/2008 | Publicover |
| 2009/0062078 | A1 | 3/2009 | VanElverdinghe |
| 2010/0190608 | A1 | 7/2010 | Publicover et al. |

OTHER PUBLICATIONS

IP Australia Re-Examination Report—Standard Patent, issued Nov. 21, 2013, in connection with the corresponding Australian patent No. 2009203614; pp. 1-5.

Declaration by Linda Burgess, executed on Aug. 29, 2013, in connection with Australian patent No, 2009203614; 6 pages total.

Manual ('multi manual') for the Action Sports Equipment Pty Ltd. KS 01100N, KS 0120N and KS 0140N, PO Box 165, Archerfield QLD 4108, Australia, Tel: 07 3719 3555, pp. 1-15 (annexed as exhibit LB1 to the Declaration by Linda Burgess, executed on Aug. 29, 2013, in connection with Australian patent No. 2009203614); 2004; 16 pages total.

Poster (annexed as exhibit LB2 to the Declaration by Linda Burgess, executed on Aug. 29, 2013, in connection with Australian patent No. 2009203614) produced by Action Sports; Jun. 1, 2014; 2 pages total.

Sample of two screenshots from Iron bark showing Action Sports sales associated with the poster for part Nos. KS0120N and KS01140N (annexed as exhibit LB3 to the Declaration by Linda Burgess, executed on Aug. 29, 2013, in connection with Australian patent No. 2009203614); 2004; 3 pages.

Manual produced by Action Sports Equipment Pty Ltd. for KS 0100E, PO Box 165, Archerfield QLD 4106, Australia, Tel: 07 3719 3555, pp. 1-30 (annexed as exhibit LB4 to the Declaration by Linda Burgess, executed on Aug. 29, 2013, in connection with Australian patent No. 20(19203614); 2007; 31 pages total.

Ironbark screenshot of a sample of sales of trampoline and enclosure combination, the KS 0100E, 1 page (annexed as exhibit LB5 to the Declaration by Linda Burgess, executed on Aug. 29, 2013, in connection with Australian patent No. 2009203614); Nov. 2, 2007; 2 pages total.

Extract from a Rebel Sport 2005 catalogue (front page, back page and one relevant page showing a trampoline), 3 pages (annexed as exhibit LB6 to the Declaration by Linda Burgess, executed on Aug. 29, 2013, in connection with Australian patent No. 2009203614); 4 pages total.

Screensliot from Ironbark showing sales to Rebel Sport Limited of models KS0140N of Dec. 2, 2005 (annexed as exhibit LB7 to the Declaration by Linda Burgess, executed on Aug. 29, 2013, in connection with Australian patent No. 2009203614); 2 pages total.

Excerpt from Sportsmans Warehouse 2007 catalogues (the front page, the back page and a relevant page showing a trampoline), 3 pages (annexed as exhibit LB8 to the Declaration by Linda Burgess, executed on Aug. 29, 2013, in connection with Australian patent No. 2009203614); 4 pages total.

Ironbark screenshots for sales associated with the Sportsmans Warehouse 2007 catalogue, 2 pages (annexed as exhibit LB9 to the Declaration by Linda Burgess, executed on Aug. 29, 2013, in connection with Australian patent No. 2009203614); 3 pages total.

Declaration by Hon Tong Chu, executed on Sep. 25, 2013, in connection with Australian patent No. 2009203614; 12 pages total.

Photograph of a trampoline with a net enclosure (annexed as exhibit CHT1 to the Declaration by Hon Tong Chu, executed on Sep. 25, 2013, in connection with Australian patent No. 2009203614); allegedly disclosed in Jan. 2004; 2 pages total.

Photographs of San Sky 12 ft trampoline and net enclosure showing how the net enclosure functioned (annexed as exhibit CHT2 to the Declaration by Hon Tong Chu, executed on Sep. 25, 2013, in connection with Australian patent No. 2009203614); 2004; 12 pages total.

Orders from Kingfisher Group that had trampoline enclosures shipped to B&Q: PO # 78912701: shipment date Jan. 10, 2005, PO # 69009101: shipment date Jan. 14, 2005, PO # 69009201: shipment date Jan. 21, 2005, PO # 69009401: shipment date Feb. 4, 2005, PO # 69009501: shipment date Feb. 11, 2005, PO # 69009801: shipment date Mar. 4, 2005, PO # 69009901: shipment date Mar. 11, 2005, PO # 69010101: shipment date Apr. 1, 2005, PO # 69010201: shipment date Apr. 8, 2005, PO # 69010401: shipment date Apr. 29, 2005 (annexed as exhibit CHT3 to the Declaration by Hon Tong Chu, executed on Sep. 25, 2013, in connection with Australian patent No. 2009203614); 2004; 26 pages total.

An email from Karen Chong of Kingfisher of Nov. 12, 2004 requesting samples of 8ft trampoline, 1 page (annexed as exhibit CHT4 to the Declaration by Hon Tong Chu, executed on Sep. 25, 2013, in connection with Australian patent No. 2009203614); 2 pages total.

An email of C.Y. Chan of Kingfisher of Jun. 10, 2004 requiring that trampoline assembly manuals be produced by San Sky, 2 pages (annexed as exhibit CHT5 to the Declaration by Hon Tong Chu, executed on Sep. 25, 2013, in connection with Australian patent No. 2009203614); 3 pages total.

Copies of approved artworks for 8-foot trampoline enclosures (part No. 806SE) boxes and 12-foot trampoline enclosures (part No. 1210SE) boxes (artworks designed by Genesis Printing and Design Co.; boxes produced by Styling Plastic Industry (Shenzhen) Co. Ltd. and shipped in early 2005), 2 pages (annexed as exhibit CHT6 to the Declaration by Hon Tong Chu, executed on Sep. 25, 2013, in connection with Australian patent No. 2009203614); 3 pages total.

Nov. 11, 2004 Draft of Trampoline enclosure assembly instructions for 8-foot trampoline enclosure (part No. 806SE) produced by San Sky, pp. 1-7 (annexed as exhibit CHT7 to the Declaration by Hon Tong Chu, executed on Sep. 25, 2013, in connection with Australian patent No. 2009203614); 8 pages total.

Nov. 11, 2004 Draft of Trampoline enclosure assembly instructions for 12-foot trampoline enclosure (part No. 1210SE) produced by San Sky, pp. 1-7 (annexed as exhibit CHT8 to the Declaration by Hon Tong Chu, executed on Sep. 25, 2013, in connection with Australian patent No. 2009203614); 8 pages total.

Dec. 2004 emails showing B&Q requesting changes to Nov. 11, 2004 drafts of trampoline enclosure assembly instructions for 8-foot trampoline enclosure (part No. 806SF) and 12-foot trampoline enclosure (part No. 1210SE), 6 pages (annexed as exhibit CHT9 to the Declaration by Hon Tong Chu, executed on Sep. 25, 2013, in connection with Australian patent No. 2009203614); 7 pages total.

Dec. 13, 2004 trampoline enclosure assembly instructions for 8-foot trampoline enclosure (part No. 806SE), pp. 1-7 (annexed as exhibit CHT10 to the Declaration by Hon Tong Chu, executed on Sep. 25, 2013, in connection with Australian patent No. 2009203614); 8 pages total.

Dec. 13, 2004 trampoline enclosure assembly instructions for 12-foot trampoline enclosure (part No. 1210SE, pp. 1-7 (annexed as exhibit CHT11 to the Declaration by Hon Tong Chu, executed on Sep. 25, 2013, in connection with Australian patent No. 2009203614); 8 pages total.

Nov. 11, 2004 assembly instructions for 8 ft trampoline (806TB), pp. 1-9 (annexed as exhibit CHTI2 to the Declaration by Hon Tong Chu, executed on Sep. 25, 2013, in connection with Australian patent No. 2009203614); 10 pages total.

Nov. 11, 2004 assembly instructions for 12 ft trampoline (1214TB), pp. 1-9 (annexed as exhibit CHT13 to the Declaration by Hon Tong Chu, executed on Sep. 25, 2013, in connection with Australian patent No. 2009203614); 10 pages total.

SGS Taiwan Ltd (SGS) Test Report No. HLD0214/2004, dated Dec. 21, 2004, for enclosure for 12 ft round trampoline (style/item No. 1210 SE), 3 pages (annexed as exhibit CHT14 to the Declaration by

(56) References Cited

OTHER PUBLICATIONS

Hon Tong Chu, executed on Sep. 25, 2013, in connection with Australian patent No. 2009203614); 4 pages total.

Declaration by Edward Dominic Gallagher, executed on Sep. 2, 2013, in connection with Australian patent No. 2009203614; 4 pages total.

Aug. 17, 2006 email front Ed Gallager, Category Manager—Solicitor of Uncle Bills (Aust) Pty Ltd to Amart All Sports stores regarding trampoline manual and enclosure instructions, 1 page (annexed as exhibit EDG1 to the Declaration by Edward Dominic Gallagher, executed on Sep. 2, 2013, in connection with Australian patent No. 2009203614); 2 pages total.

Uncle Bill's (Australia Ply Ltd. (Referred to as UBA) of 72 Silverwater Rd Silverwater Sydney Tel: 02 9648 2874 assembly, installation, care, maintenance and use instructions manuals for LS0015 (12 Ft. (365 cm) Round Trampoline), LS0016 (12ft. (365cm) Trampoline Enclosure), LS0017 (14 Ft. (426 cm) Round Trampoline) and LS0018 (14ft. (426cm) Trampoline Enclosure), 34 pages (annexed as exhibit EDG2 to the Declaration by Edward Dominic Gallagher. executed on Sep. 2, 2013, in connection with Australian patent No. 2009203614); 2006; 35 pages total.

Invoice No. S1119, dated Oct. 27, 2006, issued by Uncle Bill's (Aust) Pty Ltd to AMART ALL SPORTS of 1/168 Robertson Street, Fortitude Valley, Qld, 1 page (annexed as exhibit EDG3 to the Declaration by Edward Dominic Gallagher, executed on Sep. 2, 2013, in connection with Australian patent No. 2009203614); 2 pages total.

Purchase Order No. 5852240, Order Date: Aug. 3, 2006, Delivery Date: Nov. 1, 2006, Cancel Date: Dec. 31, 2006 (purchase order for trampolines and trampoline enclosures), pp. 1-7 (annexed as exhibit EDG4 to the Declaration by Edward Dominic Gallagher, executed on Sep. 2, 2013, in connection with Australian patent No. 2009203614); 9 pages total.

Mar. 9,-Mar. 15, 2006 Target catalogue showing trampoline and enclosures (front page, back page, and relevant page), 3 pages (annexed as exhibit EDG5 to the Declaration by Edward Dominic Gallagher, executed on Sep. 2, 2013, in connection with Australian patent No. 2009203614); 4 pages total.

Jul. 9, 2013 Letter from Jeremy Dobbin, Partner, of FB RICE of Level 23, 44 Market Street, Sydney NSW 2000, Australia (legal representative of Plum Products Limited), to the Directors of Action Sports Equipment Pty Ltd, 48B Egerton Street, Silverwater NSW 2128, Australia, regarding infringement of AU 2009203614, 2 pages (annexed as exhibit EDG6 to the Declaration by Edward Dominic Gallagher, executed on Sep. 2, 2013, in connection with Australian patent No. 2009203614); 3 pages total.

Jun. 19, to Jul. 9, 2013 Toys-R-Us catalog (front page, back page, and relevant page), 3 pages (annexed as exhibit EDG7 to the Declaration by Edward Dominic Gallagher, executed on Sep. 2, 2013, in connection with Australian patent No. 2009203614); 4 pages total.

Jun. 27, to Jul. 10, 2013 Big W mid-year toy catalogue, 2 pages (annexed as exhibit EDG8 to the Declaration by Edward Dominic Gallagher, executed on Sep. 2, 2013, in connection with Australian patent No. 2009203614); 3 pages total.

TRAMPOLINE

This is a Continuation of U.S. application Ser. No. 12/812,562, filed on Oct. 5, 2010, and allowed on Mar. 24, 2014, which was a National Stage application of PCT/GB2009/000066, filed Jan. 9, 2009, the subject matters of which are incorporated herein by reference.

BACKGROUND

This disclosure relates to trampolines.

A typical trampoline comprises a sheet (also termed: a mat), usually, though not invariably, circular, supported around its periphery within a frame like support structure by spring couplings (usually a plurality of helical springs or an elastic cord) under tension which fink apertures around the edge of the sheet to openings in the frame. The frame will generally have a configuration that matches that of the trampoline sheet or mat. Thus, when the trampoline sheet is circular, the frame will usually take the form of a generally circular ring with a diameter larger than that of the sheet in order that the sheet is stretched. When the trampoline sheet is rectangular in shape, the frame will usually comprise a ring of generally rectangular form that is similarly larger than the sheet in order that the sheet may be supported by helical springs under tension. The frame must be supported above the ground or floor. A typical trampoline support structure comprises a plurality of tubular members adapted to fit together to form the particular configuration of frame. At least some of the tubular members have a stub pipe welded thereto, which is adapted to interfit with an upper end of a respective leg, the several legs together supporting the frame and the trampoline sheet above the ground or floor. Alternatively couplings are used to interconnect the tubes of the frame with legs. The respective legs are suitably tubular and pairs of legs will typically be formed from a single tube bent into a generally U- or W-shape in which the uprights of the U or W form the legs proper, the lower ends of which are interconnected by the bight portion of the U or the central portion of the W. In the case of a U-shaped structure, the bight portion of the U provides support from the floor or ground, whereas in a W-shaped structure the lower angular corners of the "W" serve the same purpose.

A pad, annular when the trampoline sheet or mat is circular, generally covers the helical springs or cord so that a user does not hurt themselves as they climb on to the trampoline or step off it.

Users are warned only to bounce in the centre of the sheet or mat. Users are also warned that only one person at a time should use the trampoline. Unfortunately children pay little heed even to explicit warnings. Net enclosures have been provided to give at least a measure of protection and a feeling of security to a user against inadvertently falling off the trampoline on to the ground. The net enclosure is mounted on a plurality of generally upright poles that extend above the frame and are commonly attached to the legs. The net obviously requires an entrance/exit between two such poles so that users can climb on and off the trampoline.

Commonly the net is sewn to a plurality of sheaths, each of which simply slides over a respective pole so that the net generally corresponds with the outer periphery of the frame. The annular pad lies within this periphery. Thus, even though the enclosure may offer some protection against a child falling off the trampoline, they may still fall on to the pad or tread heavily on the pad and be hurt as a result by the unyielding helical springs beneath the pad.

To overcome this problem, smaller net enclosures have been provided in which the position of the net generally corresponds with the inner periphery of the pad, the net being mounted from the poles either by respective ties which may be individually fastenable or be sewn both to the net and to respective sheaths that slide over the poles. In either event, this construction is both not a strong as the prior arrangement in which the net is sewn directly to each sheath along its length, and also significantly reduces the generally usable area of the trampoline sheet, as an active user will come into contact with the net in this arrangement as they bounce near the edge of the sheet, and gives users a cramped enclosed feeling.

Until the present disclosure, there has been no satisfactory solution to these problems. Users requiring a net enclosure had to opt either for an outer periphery net enclosure with a risk of falling or stepping on the pad, or a weaker inner periphery net enclosure that prevented pad injuries but had other drawbacks.

SUMMARY OF THE DISCLOSURE

In accordance with a first aspect of the present disclosure, a trampoline comprises a trampoline sheet or mat supported around its periphery from a circumextending support structure by spring couplings (preferably a plurality of helical springs) under tension, and is provided with a net enclosure in which a generally circumextending net is mounted by respective sheaths on a plurality of poles coupled to the support structure and extending generally upright therefrom, so that, in use, for the greater part of its height, the position of the net corresponds generally to the periphery of the support structure, while lower edge regions of the net are coupled to the periphery of the sheet or mat inboard of the support structure, thereby at least largely preventing a user from falling or treading upon the annular pad and spring couplings therebeneath.

The terms "circumextending" and "annular", as used herein, are not intended to have the effect of limiting the trampoline only to circular configurations. These terms are intended equally well to apply to trampolines with other configurations such as a hexagonal configuration trampoline or a generally rectangular configuration trampoline in which the pad will take a generally frame-like configuration rather than a ring-like form.

It will be understood that the net must necessarily include a (preferably closable) opening to allow users to enter and exit the enclosure. The support structure suitably comprises a tubular frame mounted above the ground or floor by a plurality of legs. The poles are suitably attached to respective legs by clamps or screw fixings, and may extend for the full height of the trampoline from the ground to the top of the net. They may be formed in sections that may be coupled together or be telescopic.

In a second and alternative aspect of this disclosure, there is provided a trampoline comprising a trampoline sheet or mat; circumextending support structure therefor, the sheet or mat being supported around its periphery from said support structure by spring couplings (preferably a plurality of helical springs) under tension, the support structure comprising a tubular frame and a plurality of legs supporting the frame, and the spring couplings being covered by an annular pad; and a net enclosure comprising a generally circumextending net mounted on a plurality of poles coupled to the support structure and extending generally upright therefrom, respective sheaths for the poles, to which sheaths the net is directly coupled so that, in use, for the greater part of its height, the position of the net corresponds generally to the periphery of the support structure, and respective members generally in the form of a right triangle mounted to lower regions of the net adjacent the annular pad, each said member having a first edge attached to a said sheath, a second edge extending towards the centre of the sheet and overlying the pad, and a third edge extending between the first and second edges and attached to a lower region of the net.

In preferred arrangements, the apex between the second and third edges is elastically coupled to the periphery of the sheet or mat, for example to rings for inner ends of the helical springs by a flexible elastic member and a carabiner; and the third edge is curved. The member may be formed of a plastics sheet with an eyelet for the elastic member. Alternatively, the elastic member may be sewn to the said apex.

BRIEF DESCRIPTION OF THE DRAWINGS

Referring now to the accompanying drawings, in which.

DESCRIPTION OF PRIOR ART AND OF PREFERRED EMBODIMENTS

Figure 1:
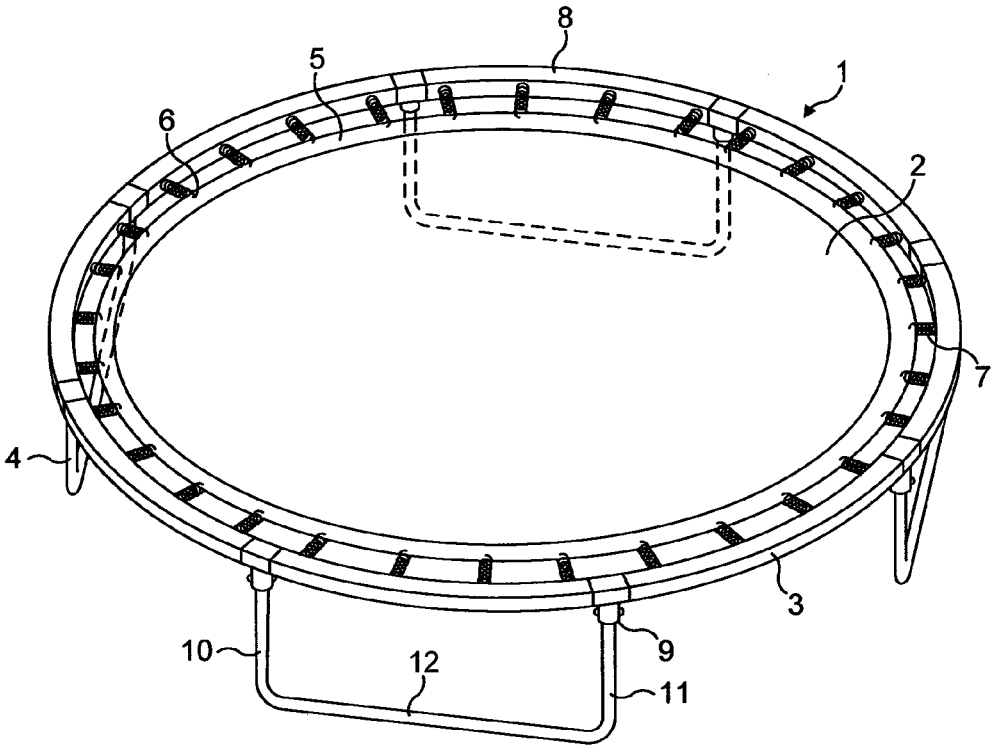
FIG. 1 PRIOR ART
FIG. 1 shows a trampoline with parts omitted to illustrate the structure.

Referring first to FIG. 1, there is shown a trampoline 1 comprising a trampoline sheet or mat 2 stretched within a frame 3 forming part of a support structure 4 for the trampoline sheet. The sheet or mat 2, here circular, has a reinforced edge 5 formed with a plurality of eyelets 6 into each of which is fitted one end of a respective helical spring 7. The other end of spring 7 is fitted into a respective opening in the frame 3. The openings for the springs are here provided on the radially inner side of the frame 3, but may, instead, be provided on the vertically upper side of the frame. As an alternative to a plurality of helical springs, another form of spring coupling could be used such as an elastic cord interlacing the eyelets 6 with openings in the frame.

As the sheet/mat is circular, the frame 3 is here of a generally circular ring form, but it will be understood that the sheet/mat may have other shapes, with a correspondingly shaped frame. Frame 3 comprises a plurality of tubular members 8, coupled together by couplings 9. Although the frame is here shown with a generally square tubular cross-section it may equally well be formed of circular sectioned tubes. The frame is supported by a plurality of leg structures 10. In this embodiment adjacent legs 11 are connected by a bight portion 12 in a generally U-form leg structure 10.

Although omitted from FIG. 1 so that the springs 7 may be seen, the reinforced edge 5 of the sheet/mat 2, the springs 7 and the frame 3 will all be covered by an annular pad (identified 13 in each of FIGS. 2 to 6) enabling a user to climb on to or off the trampoline without hurting themselves.

Figure 2:
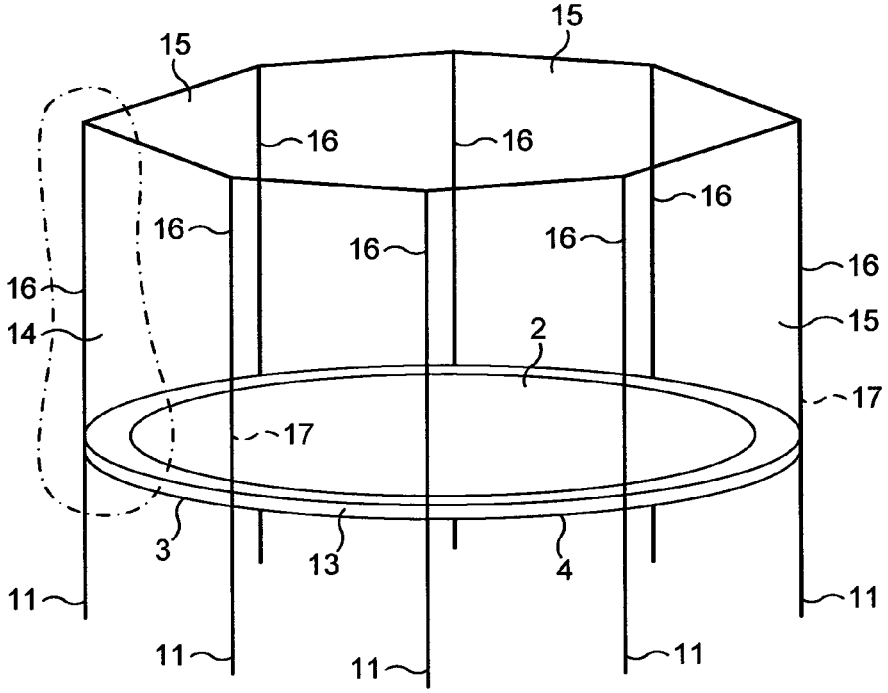
FIG. 2 PRIOR ART
FIG. 2 is highly schematic view of a prior trampoline provided with a net enclosure.

FIG. 2 schematically illustrates how a circumextending net enclosure may be provided in a prior trampoline. Net 14 surrounds the space above sheet 2 with the intention, in effect, of substantially containing a user, especially an inexperienced user such as a child, and is formed from a plurality of netting panels 15 supported between respective sheaths 16 mounted over poles 17 that extend upwardly from the support structure 4. At least one of the netting panels 15 must be openable to allow users to enter or leave the enclosure.

Figure 3:
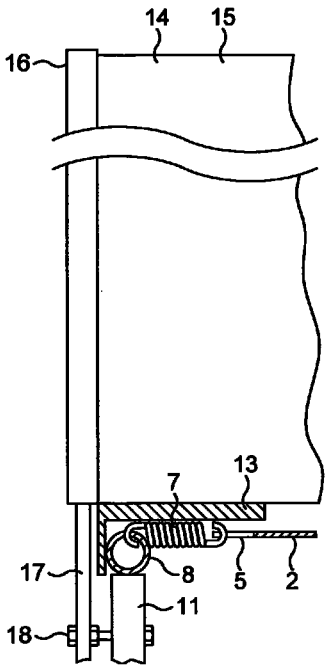
FIG. 3 PRIOR ART
FIG. 3 is a scrap, part sectional, view of the portion ringed in FIG. 2.

FIG. 2 suggests that the upstanding poles may form extensions of legs 11. Alternatively as shown in FIG. 3, the poles 17 may be attached by screw fittings 18 (alternatively by clamps) to the outerside of legs 11 below frame 3. As can be seen from FIGS. 2 and 3, while this arrangement may serve substantially to contain a user, the user may still fall on or inadvertently step on the pad 13, and so hurt themselves on the springs 7 beneath the pad.

Figure 4:
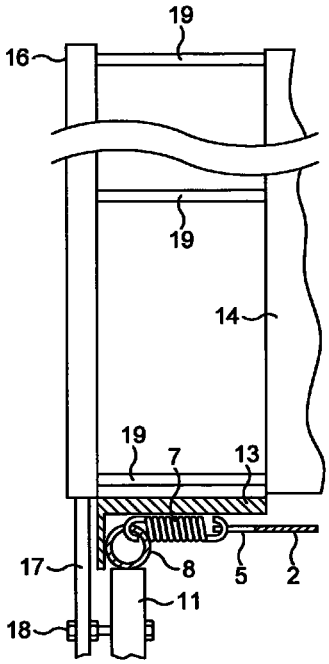
FIG. 4 PRIOR ART
FIGS. 4 and 5 are views similar to FIG. 3 for other prior embodiments of trampoline.
Figure 5:
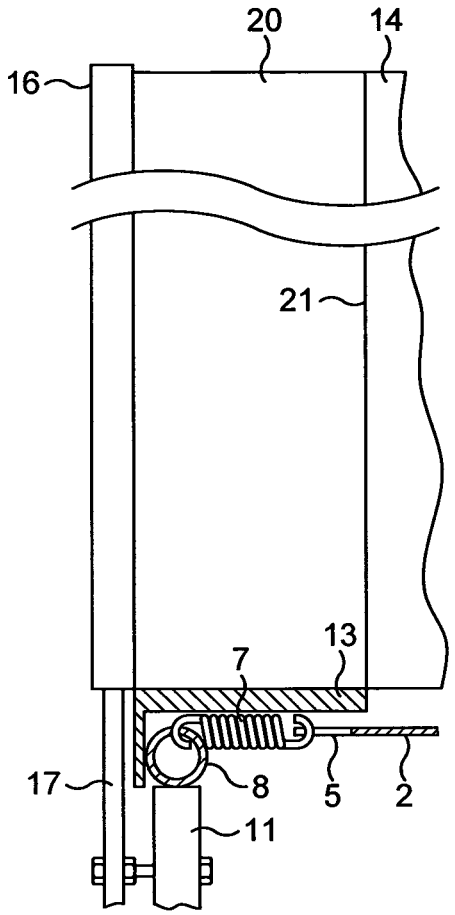
FIG. 5 PRIOR ART

The prior structure shown in FIG. 4 overcomes this problem by bringing the net inwardly to the inner edge of the pad, but at the expense of reducing the useful area of the trampoline. As shown a plurality of spaced ties 19 connect the sheath to the netting. Alternatively, as shown in FIG. 5, each sheath 16 may be connected to a web 20, the net being stitched to inner edges 21 of the respective webs. In either case, the reduction in the enclosed area is significant. For example, if the net is reduced to the inner periphery of pad 13 in the embodiment of FIG. 2, the reduction in enclosed area would be over 20%. As a result, users feel cramped and threatened by the enclosing net in such arrangements.

Figure 6:
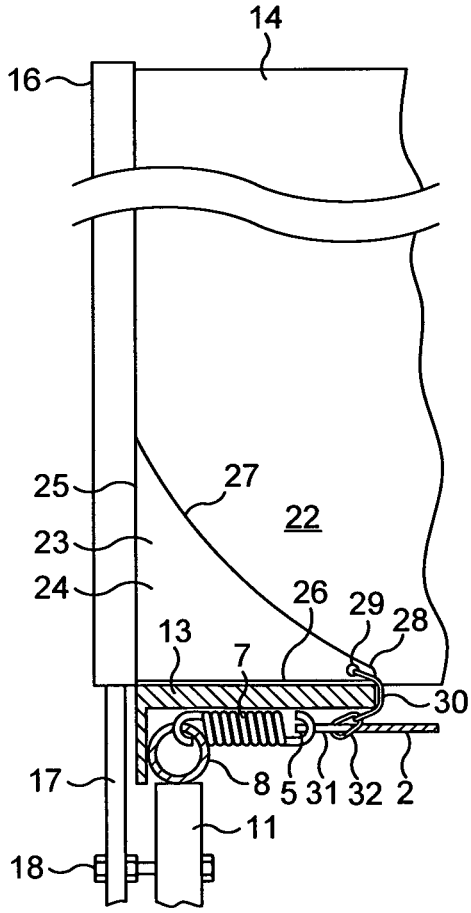
FIG. 6 is another similar view for an example of a trampoline constructed according to the present disclosure.

FIG. 6 shows how injury by contact with the pad 13 and the underlying springs therebeneath may be largely avoided without reducing the useful area of the trampoline. Net 14 is stitched to sheath 16 over the greater part of its height above the trampoline sheet/mat, so that the position of the net generally corresponds to the periphery of the support structure. However, a lower portion 22 of the net 14 is stitched to a member 23 generally in the form of a right triangle 24, one edge 25 of which member is stitched to sheath 16, while another edge 26 at right angles to edge 25 overlies pad 13. Lower portion 22 of the net is stitched to hypotenuse edge 27, which may be curved slightly, as shown in FIG. 6. Member 23 is suitably formed of plastics sheet, as may be sheath 16. Although still possessing some flexibility, the sheath 16 and member 23 will be significantly more rigid than the net 14. Apex 28 between edge 26 and hypotenuse edge 27 is suitably provided with an eyelet 29 allowing an elastic cord 30 to connect that apex to an opening 31 in reinforced edge 5, the opening also being employed for spring 7. Alternatively, elastic cord 30 may simply be stitched to apex 28. The elastic cord 30 is preferably fastened to opening 31 via a carabiner 32, and serves to hold member 23 taut. We have found that the member 23 serves a useful purpose in that it may readily be held taut, ensuring that the edge of the lower portion of the net is located at the inner edge of the pad, and thereby s preventing a user from injuring themselves by contact with the pad and underlying springs, without stretching the netting.

The arrangement of FIG. 6 thus neatly achieves the divergent respective advantages of the structure of FIGS. 2 and 3 and of the structure of either FIG. 4 or 5, without, at the same time, incurring the disadvantages inherent in either.

The invention claimed is:

1. A trampoline comprising a trampoline sheet or mat supported around its periphery from a circumextending support structure by spring couplings under tension; the trampoline being provided with a net enclosure in which a generally circumextending net is mounted by respective sheaths on a plurality of poles coupled to the support structure and extending generally upright therefrom, the circumextending net having a first upper portion and a second lower portion contiguous with the first upper portion, the first upper portion being coupled to each of the sheaths at positions from an uppermost end of the sheaths mounted on their respective poles to an intermediate position between the uppermost end and a level defined by the sheet or mat, and the second lower portion being coupled to each of the sheaths at said intermediate position and having a lowermost edge coupled to the periphery of the sheet or mat inboard of the support structure, whereby, substantially about the whole of the net, the second lower portion serves at least largely to prevent a user from falling or treading upon the spring couplings, while the first upper portion extends for the greater part of the height of the circumextending net from an uppermost end of the circumextending net down to the height of the intermediate position at a position that corresponds generally to the periphery of the support structure.

2. A trampoline according to claim 1, wherein the support structure comprises a tubular frame mounted above a surface on which the trampoline stands by a plurality of legs; and wherein the poles are attached to respective legs by clamps or screw fixings.

3. A trampoline according to claim 2, wherein the poles extend substantially for the full height of the trampoline from the surface on which it stands to the top of the net.

4. A trampoline according to claim 1, wherein the poles are formed in sections that may be coupled together.

5. A trampoline according to claim 1, wherein each pole is telescopic.

6. A trampoline according to claim 1, wherein the spring couplings are helical springs.

7. A trampoline according to claim 1, wherein each pole is coupled to a leg and the poles extend parallel to the legs.

8. A trampoline according to claim 7, wherein each leg is in a generally U-form comprising two upright portions connected by a connecting portion and the poles are coupled to and extend parallel to the upright portions.

9. A trampoline comprising a trampoline sheet or mat supported around its periphery from a circumextending support structure by spring couplings under tension, the spring couplings being covered by an annular pad; the trampoline being provided with a net enclosure in which a generally circumextending net is mounted by respective sheaths on a plurality of poles coupled to the support structure and extending generally upright therefrom, the circumextending net having a first upper portion and a second lower portion contiguous with the first upper portion, the first upper portion being coupled to each of the sheaths at positions from an uppermost end of the sheaths mounted on their respective poles to an intermediate position between the uppermost end and a level defined by the sheet or mat, and the second lower portion being coupled to each of the sheaths at said intermediate position and having a lowermost edge coupled to the periphery of the sheet or mat inboard of the support structure, whereby, substantially about the whole of the net, the second lower portion serves at least largely to preventing a user from falling or treading upon the annular pad overlying said couplings, while the first upper portion extends for the greater part of the height of the circumextending net from an uppermost end of the circumextending net down to the height of the intermediate position at a position that corresponds generally to the periphery of the support structure.

10. A trampoline according to claim 9, wherein the support structure comprises a tubular frame mounted above a surface on which the trampoline stands by a plurality of legs; and wherein the poles are attached to respective legs by clamps or screw fixings.

11. A trampoline according to claim 10, wherein the poles extend substantially for the full height of the trampoline from the surface on which it stands to the top of the net.

12. A trampoline according to claim 9, wherein the poles are formed in sections that may be coupled together.

13. A trampoline according to claim 9, wherein each pole is telescopic.

14. A trampoline according to claim 9, wherein the spring couplings are helical springs.

15. A trampoline according to claim 9, wherein each pole is coupled to a leg and the poles extend parallel to the legs.

16. A trampoline according to claim 15, wherein each leg is in a generally U-form comprising two upright portions connected by a connecting portion and the poles are coupled to and extend parallel to the upright portions.

* * * * *